United States Patent [19]

Farber

[11] Patent Number: 4,495,959

[45] Date of Patent: Jan. 29, 1985

[54] COIN COUNTING DEVICE

[76] Inventor: Hobart A. Farber, Luther Crest, Apt. 324, 800 Hausman Rd., Allentown, Pa. 18104

[21] Appl. No.: 564,690

[22] Filed: Dec. 23, 1983

[51] Int. Cl.[3] ..... G07D 3/04; B65B 5/00

[52] U.S. Cl. ..... 133/1 A; 53/254; 133/3 D

[58] Field of Search ..... 133/1 A, 3 D, 8 A, 8 B, 133/8 C, 8 D, 8 E, 8 R; 53/212, 213, 254; 206/0.82, 0.83

[56] References Cited

U.S. PATENT DOCUMENTS

| | | | |
|---|---|---|---|
| 2,149,444 | 3/1939 | Kohlmann | 53/212 X |
| 3,313,477 | 4/1967 | Brown | 133/3 R X |
| 3,338,250 | 8/1967 | Mehelich | 133/3 R |
| 3,521,649 | 7/1970 | Warrix | 133/3 R |
| 3,678,650 | 7/1972 | Green | 53/254 X |

*Primary Examiner*—F. J. Bartuska

*Attorney, Agent, or Firm*—Ruth Moyerman

[57] ABSTRACT

A coin counting device is disclosed. The device has a base sized to receive the open bottom of a coin sorter. The base's top has vertical compartments (open at their ends) aligned with similarly sized compartments in the coin sorter. Coin receiving tubes, open at one end and placed in the compartments, extend through the base's top into the sorter. Tubes are sized to receive coins of given denominations in amounts needed to fill standard coin wrappers for that denomination. The base also includes tube retainers to keep the tubes in their compartments and a locking bar and a U-shaped encasement to lock all tubes within the base. When the tube retainers and lock are removed, a tube drops through the base's bottom. An open end of a filled coin receiving tube is placed in a compatibly sized aid which is lined with a standard coin wrapping paper. Stacked coins are then emptied from their tube into the wrapper.

3 Claims, 8 Drawing Figures

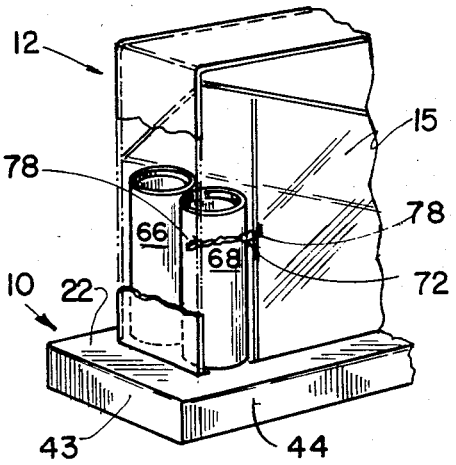
FIG. 6
FIG. 3
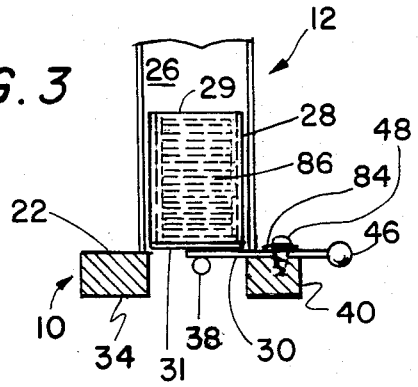
FIG. 4
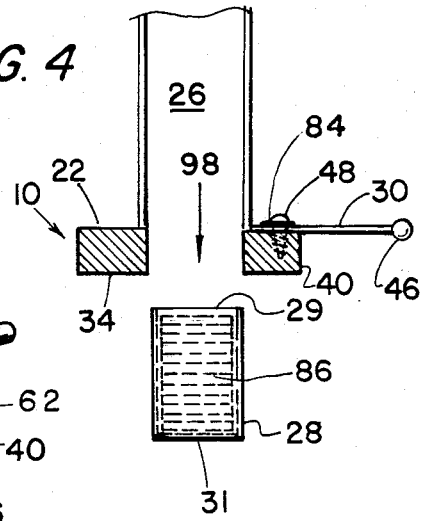
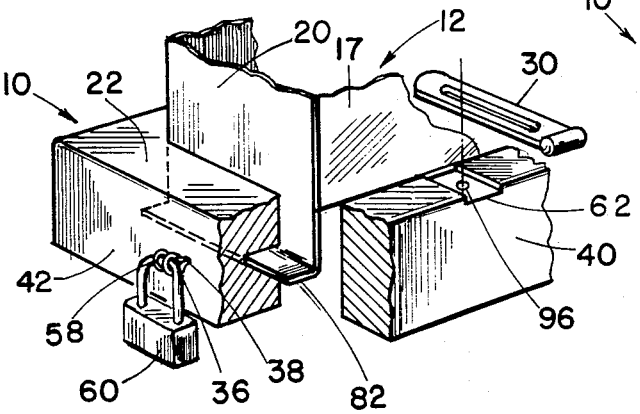
FIG. 7
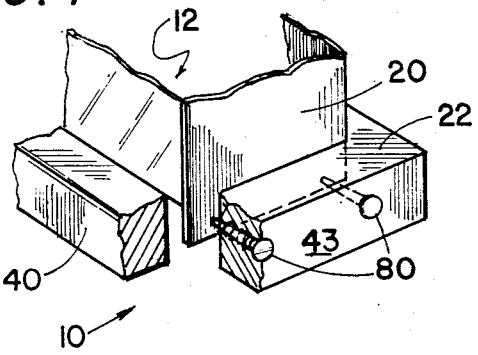
FIG. 8
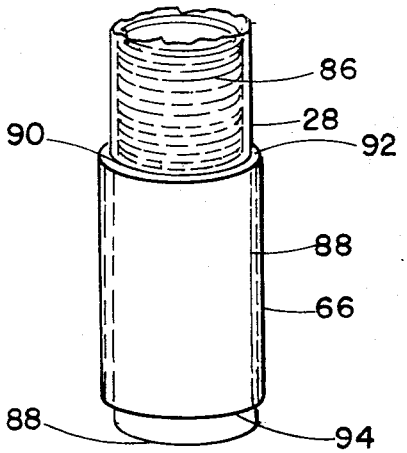
FIG. 5

COIN COUNTING DEVICE

BACKGROUND OF THE INVENTION

1. Field of the Invention

This invention relates to banks, and more particularly to coin packaging and stacking.

2. Description of the Prior Art

There are many devices on the market which serve as coin collectors. Many of these devices are designed for children. Of these, U.S. Pat. No. 3,313,477 to Brown is designed to function as a toy and educational device, as well as to serve as a sorter and container for coins. Brown's device provides no means for inserting the sorted and stacked coins into wrappers for counting; when Brown's bank is emptied, all the coins fall out at once, no longer sorted or stacked.

There is, therefore a need for a device which incorporates the coin sorting features of U.S. Pat. No. 3,313,477 with a base to provide means for simplifying the counting and wrapping of coins in their stacked formation.

SUMMARY OF THE DISCLOSURE

The aforementioned prior art problems are obviated by the device of this invention in which a base, used in conjunction with a predetermined coin sorter, includes tubes for stacking coins in the correct amounts for wrapping in standard coin wrappers.

The device has a base sized to receive the open bottom end of a coin sorter. The base's top has compartments aligned with compartments in the coin sorter. Coin tubes, open at one end and having the circumference of different denominations of coins, are placed in the compatably-sized compartments, open end of the coin tubes in the coin sorter. The closed end of the tubes extends into the base's top. The base is hollow so that the tubes may be removed, through its bottom, when they are filled. Each tube is preferably sized to hold the exact number of coins needed to fill the appropriate coin wrapper for that denomination of coin. Thus, wrapping and counting of coins is simplified for the user of this device.

The device also includes tube retainers which prevent the tubes from falling out of the base until the user releases them. There is also a rod-like locking device to prevent undesired removal of the filled coin tubes.

The side and top walls of the coin sorter are covered with a casing which extends into the base, preventing removal of the coin sorter from the base. Additionally, aids in the form of tubes are provided to simplify wrapping of the coins.

It is, therefore, an object of this invention to provide a device which will simplify coin counting and wrapping.

It is another object of this invention to provide a device which will neatly store coins.

It is yet another object of this invention to provide a device for counting coins which is suitable for household use.

It is still another object of this invention to provide a device which will increase circulation of coins by providing a simple means for coin savers to return said coins to a bank in suitable wrappers.

It is a further object of this invention to provide an educational device for children which will teach children how to identify and count the coins used in their currency system.

It is still another object of this invention to provide a device which encourages saving, since the fascination of seeing coins roll and drop into the proper coin tubes is an incentive to children to drop coins.

It is yet another object of this invention to provide a device which affords parents the opportunity to observe and control the saving and spending habits of their children.

It is still a further object of this invention to provide a tamperproof casing for a coin counting device, thereby encouraging saving in homes where the device is used.

It is yet a further object of this invention to provide a coin counting device where the deposited coins may be removed only when the device has been unlocked.

These and other objects will be more readily ascertainable to one skilled in the art fronm a consideration of the Figures and the following description and exemplary embodiment.

BRIEF DESCRIPTION OF THE DRAWING(S)

FIG. 1 is a perspective of the device showing all coin receiving tubes in place.

FIG. 2, taken on lines 2—2 of FIG. 1, shows the tube retainers with locking rod in place.

FIG. 3 is a cross section taken on lines 3—3 of FIG. 2 showing one compartment and its coin filled tube held in place by a tube retainer.

FIG. 4 illustrates the same view as in FIG. 3, but in FIG. 4, the tube has been released from its compartment.

FIG. 5 is a view of an aid being filled with coins.

FIG. 6 is a rear view of the device showing the aids in storage.

FIG. 7 is a cut-away view showing the locking device and one end of the casing extending into the base.

Figure 2:
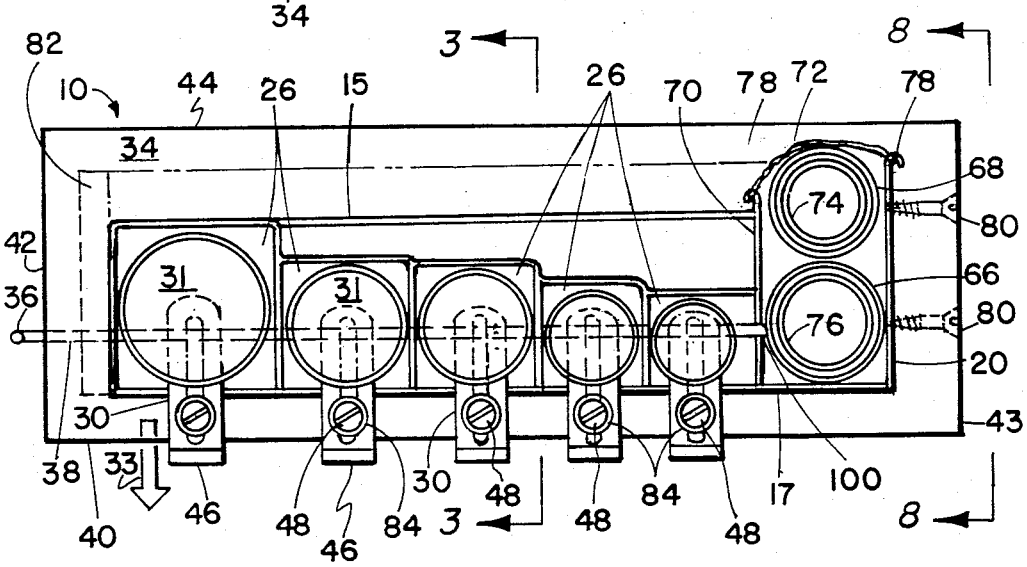

FIG. 8, taken on lines 8—8 of FIG. 2, is a cut-away showing the casing's other end as it is fastened in the base.

DETAILED DESCRIPTION OF THE PREFERRED EMBODIMENT(S)

Figure 1:
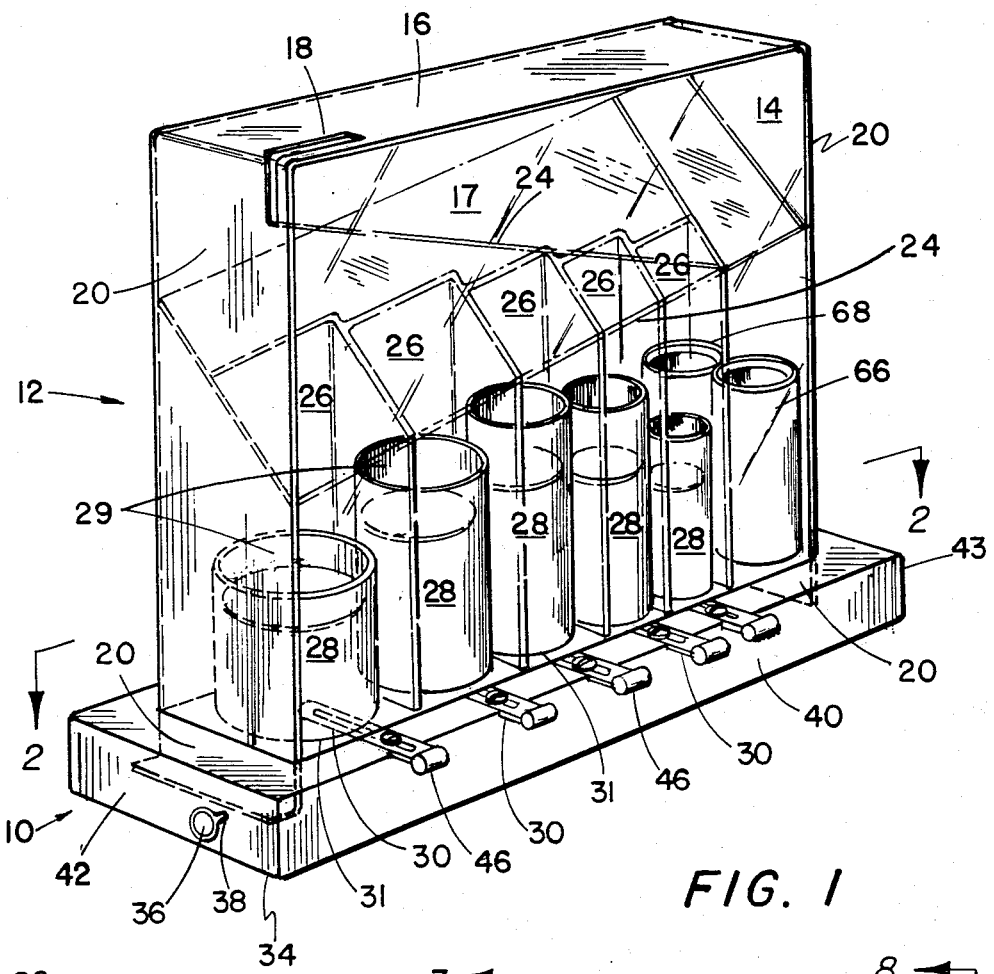

Referring now to the drawings, and more particularly to FIG. 1, the device of this invention is seen including base 10 and coin sorter 12. As seen in FIG. 1, and all other drawings, coin sorter 12 is illustrated to conform with the device in U.S. Pat. No. 3,313,477 which is hereby incorporated by reference. Coin sorter 12, in all views, is transparent allowing all tubes and coins to be visible. Coin sorters of a similar nature to U.S. Pat. No. 3,313,477 may also be adapted for use with base 10 of this invention.

Coin sorter 12 includes sides 14, front 17 and top 16. Top 16, covered by casing 20, has coin slot 18 extending through top 16 and casing 20 to receive coins. It can be seen in FIG. 1 that sides 14 and top 16 have been encased and that casing 20 is a band which extends into base 10, holding coin sorter 12 firmly on base 10. Casing 20, not transparent, hides wall 14 and some of tube 28 in this Figure. The tamperproof nature of casing 20 is more fully explained in FIGS. 7 and 8.

Coins inserted in coin slot 18, which extends through casing 20 and top 16, slide down ramp 24 to drop into a compartment 26 according to the size of the coin. The coin then enters open end 29 of coin receiving tube 28 and is held in tube 28 for stacking and storage.

Coin receiving tubes 28 extend from compartment 26 into base 10 where their closed ends 31 rest on tube retainers 30. Base 10 is hollow, allowing tubes 28 to be removed through bottom 34 of base 10 when tubes 28 are filled with coins. Tube retainers 30 include handle ends 46 to facilitate their movement.

Also shown in FIG. 1 are front wall 40 and side walls 42 and 43 of base 10. In side wall 42, eye 36 of locking rod 38 may be seen in this view. Locking rod 38 is more clearly seen in FIGS. 2, 5 and 7.

When a coin receiving tube 28 is filled to capacity, it will preferably hold the exact number of coins needed to fill a coin wrapper for that coin denomination. The half dollar tube will hold twenty coins ($10.00); the quarter tube will hold forty coins ($10.00); the nickel tube will hold forty coins ($2.00); the penny tube will hold fifty coins ($0.50) and the dime tube will hold fifty coins ($5.00). When locking rod 38 is removed by being pulled out, tube retainer 30 may be withdrawn, causing coin receiving tube 28 to drop through bottom 34 of base 10. Coins may then, by using aids 66, 68, 74 or 76 (aides 74 and 76 not shown), be easily inserted into a wrapper for accurate counting.

It may also be seen in FIG. 1 that each tube 28 is of a different diameter and height. The different diameters of each tube provide for the different denominations of coins. The heights of each tube 28 are such that, when each coin receiving tube 28 is filled, the number of coins (previously enumerated) in that tube 28 will be that number which exactly fills a standard paper coin wrapper for that particular denomination of coin. The entire height of coin sorter 12 is determined by the height of nickel coin tube 28. There must be a distance between ramp 24 and the top of nickel coin tube 28 of at least 90% of the diameter of a nickel to allow the coins to fall flat into the tubes 28.

Referring now to FIG. 2, base 10 is seen having bottom 34, sides 42 and 43, front 40 and back 44. Back wall 15 and front wall 17 of coin sorter 12 are seen in this view. Closed ends 31 of coin receiving tubes 28 are seen resting on tube retainers 30. Locking rod 38 with eye 36 is shown spanning all tube retainers 30 and entering into wall 70 at aperture 100. Coin receiving tube(s) 28 may be removed only when locking rod 38 is withdrawn past the desired tube 28 and the corresponding tube retainer 30 for that coin receiving tube 28 is also drawn out in the direction indicated by arrow 33.

Also seen in FIG. 2 are handle ends 46 of tube retainers 30. These ends 46 are enlarged to allow for easier grasping of tube retainer 30. Tube retainers 30 are seen held in place by pins 48 and their washers 84. Pins 48 prevent retainers 30 from being completely removed from base 10. Washers 84 hold retainers 30 level underneath tubes 28.

Also seen in FIG. 2, in nested arrangement, are aids 66, 68, 74 and 76 which are held in place by band 72. Aid 66 is sized to receive quarters and aid 68 is sized to receive nickels. Aid 74, stored inside aid 68, receives dimes and aid 76, stored inside aid 66, is sized to receive pennies. Band 72, preferably a rubber band, is removably attached to hooks 78 and holds aids 66, 68, 74 and 76 in storage. A few twists of rubber band 72 over hooks 78 holds aids 66, 68, 72 and 76 in place. One end of band 72 is removed from a hook 78 to allow removal of an aid 66, 68, 74 or 76 when it is needed. Use of aids, 66, 68, 74 and 76 is fully explained in FIG. 5.

Also seen in FIG. 2 are screws 80 which fasten casing 20 into side 43 of base 10. Lip 82 of casing 20 is seen in base 10 at base 10's other side. Lip 82 and screws 80 are more clearly explained with reference to FIGS. 7 and 8.

Now referring to FIG. 3, a cross section of a compartment 26 is shown. Coin receiving tube 28, filled with coins 86, is in place extending from base 10 to compartment 26 in coin sorter 12. Closed end 31 of coin receiving tube 28 rests on tube retainer 30 and open end 29 of coin receiving tube is in compartment 26.

Base 10 is seen having front wall 40, top 22 and bottom 34. Tube retainer 30, with handle end 46 outside of front wall 40, is also visible. Tube retainer 30 extends from front wall 40, through transverse channel 62 (seen in FIG. 7) and across tube bottom 31, preventing coin receiving tube 28 from dropping out of base 10. Locking rod 38 is seen under tube retainer 30, also preventing tube 28 from being removed from base 10.

Also seen in cross section is pin 48 and washer 84. Pin 48 prevents tube retainers 30 from pulling completely out of base 10 as shown in FIG. 4.

Now referring to FIG. 4, the same view as FIG. 3, shows a coin receiving tube 28 with top with top 29 and bottom 31. Tube 28 has been filled with coins 86 and released from base 10 in the direction of arrow 98. Base 10 is seen with top 22, bottom 34 and front wall 40. Locking rod 38 (seen in FIG. 3) has been withdrawn from base 10. Tube retainer 30 with handle end 46 is still resting resting on top 22 of base 10, but is clearing compartment 26. With its retainer 30 and rod 38 withdrawn, coin receiving tube 28 has dropped in the direction of arrow 98 from compartment 26 and base 10, and is available for use with an aid. Pin 48 with washer 84 is seen preventing tube retainer 30 from being completely withdrawn from base 10.

Thus, it has been illustrated in FIGS. 3 and 4 how tube retainers 30 act as a support for coin receiving tubes 28 and how tube retainers 30 and locking rod 38 are withdrawn to release coin receiving tubes 28.

Now referring to FIG. 5, it is shown how aids 66, 68, 74 and 76 are used. Only aid 66, sized to receive quarters, has been illustrated, but all aids are constructed and used in the same manner. Tube 28, in this Figure, is sized to receive quarters and has been filled with coins 86 and removed as illustrated in FIG. 4. Aid 66 is a hollow cylinder having open top 92 and open bottom 94. Aid 66 has been fitted with open quarter coin wrapper 88. Top 92 of aid 66 has interior shoulder 90. Tube 28 is held so that open end 29 rests on shoulder 90. Coins 86 then fall into wrapper 88 inside aid 66.

Thus, coins inserted into coin sorter 12 (as seen in FIG. 1) fill up a coin tube 28, are released stacked in their tube 28 (as seen in FIGS. 3 and 4), and are easily wrapped in their stacked position by using aids 66, 68, 74 and 76.

Referring now to FIG. 6, storage of aids 66, 68, 74 and 76 (aids 74 and 76 not shown) in coin sorter 12 is shown. Aids 66 and 68 are shown resting on base 10 which has top 22, back 44 and side 43. Aids 66 and 68 are held on top 22 of base 10 by band 72 which is latched onto hooks 78. When band 72 is removed from hooks 78, aids 66 and 68 may be removed from back 15 of coin sorter 12. Aids 74 and 76 may be removed from aids 68 and 66 respectively once aids 66 and 68 are removed from coin sorter 12.

Now referring to FIG. 7, the locking features of this invention are shown. On side 42, base 10 is fitted with additional eye 58 in a position parallel to eye 36 of locking rod 38. When eyes 36 and 58 are aligned, locking rod 38 extends completely across all coin receiving tubes 28 as seen in FIG. 2. Padlock 60 is then fastened through both eyes 36 and 58 securing and locking rod 38. Thus, no tubes 28 may be removed from base 10, even if tube retainers 30 are withdrawn since all coin tubes 28 are spanned by locking rod 38.

The locking feature provided by casing 20 is also shown in FIG. 7. Casing 20 covers sides 14 and top 16 and extends through top 22 of base 10. Immediately below top 22, casing 20 forms lip 82. Casing 20 holds coin sorter 12 in place on base 10 by preventing coin sorter 12 from being lifted off base 10. The other end of casing 20 is also firmly attached to base 10 as seen in FIG. 8.

Also shown in FIG. 7 is transverse channel 62 which allows reciprocating motion for tube retainer 30. Transverse channel 62, located on top 22 of base 10, extends horizontally from front wall 40 to compartment 26 (not shown) of coin sorter 12. Tube retainer 30 is shown removed so that channel 62 is visible. Aperture 96 is now also visible. Aperture 96 receives pin 48 which holds tube retainer 30 in place in channel 62. Channel 62 allows tube retainer 30 to slide under front wall 17 of coin sorter 12 so that it can extend across compartment 26 (not shown).

Referring now to FIG. 8, the securing of casing 20 to base 10's other end is shown. Base 10, having top 22, side 43 and front 40, is shown supporting coin sorter 12. Casing 20, which covers coin sorter 12 on sides 14 and top 16 (not shown), extends through top 22 into base 10. Screws 80 are inserted through side 43 and into casing 20. Screws 80 may be countersunk and then covered with a putty and painted.

It has been seen in FIGS. 7 and 8 that removal of tubes 28 is possible only if the optional padlock has been opened, locking rod 38 pulled out, and tube retainers 30 withdrawn. Coin sorter 12 cannot be lifted from its base 10 because casing 20 is firmly attached to base 10.

There are many variations which may be practiced within the scope of this invention.

Casing 20 is shown fastened to base 10 by screws 80. However, any method of secure attachment may be employed and still be within the scope of this invention.

Also, it is possible to use another model of coin sorter as long as it would align properly in a base 10.

Coin receiving tubes 28 are shown one each for pennies, nickels, dimes, quarters and half dollar pieces. It would be within the scope of this invention to eliminate the half dollar compartment.

Aids 66, 68, 74 and 76 are described as having interior shoulders. Any configuration which would permit the aids to receive tubes 28 is within the scope of this invention.

In addition, the invention may be used with or without the padlock and additional eye seen in FIG. 7.

The device of this inventions has many advantages. Chiefly among these is its convenience. The prestacking of coins in the amounts needed to fill standard coin wrappers with the coins still in stacked relationship makes it easy for the coin saver to return coins to the bank, precounted and wrapped, ready to return to circulation.

Secondly, this device is a good educational tool, teaching children to recognize and count coins of different denominations.

Thirdly, this device provides a locked container for collecting coins.

Having now described and illustrated my invention, it is not intended that such description limit this invention, but rather that this invention be limited only by a reasonable interpretation of the appended claims.

What is claimed is:

1. A device for counting coins to be used in conjunction with a compartmentalized coin sorter, said device comprising:

(a) a generally parallelpipedal, hollow base of a size to receive an open bottom end of a coin sorter on said base's top, said base including also side walls, a compartment forming wall, back and front walls and a partially open bottom;

(b) at least one tube compartment of a size to hold a coin receiving tube, said compartment(s) extending vertically from said sorter, through said base's top, each defining an opening in said base's top, said compartments placed between a first side wall to said compartment forming wall;

(c) a plurality of coin receiving tubes, each open at one end and each sized circumferentially to receive coins of a different given denomination in stacked relationship, said tubes being removably mounted in said sorter's compartment(s);

(d) tube retaining means in said base to prevent said tube(s) from dropping from said compartment(s) through said base's bottom opening, said tube retaining means including:

(i) at least one transverse channel in said base's top from said front wall to said compartment openings to receive a tube retainer, said channel including a pin and a washer, said pin extending vertically through each slot so that said tube retainer(s) may not be completely removed from said slot(s), said washer placed between said pin and said retainer to hold said retainer level;

(ii) a tube retainer slidably mounted in each of said channels and out of a length to extend horizontally through said channel(s) and across said tube compartment's(s') base end, supporting said tube's closed bottom thereon, said tube retainer being generally a slotted rectangular bar having one end of said bar extending out of said base's top, said extending end enlarged for grasping by a user's finger;

(e) a U-shaped encasement on said coin sorter's top and side walls, said encasement attached to said base; and, (f) means to lock said tube(s) in said base, said locking means including:

(i) a locking rod slidably and removably mounted through said base's first side wall, into an aperture in said compartment forming wall, said rod's one end ending in an eye; and, (ii) an eye bolt located on said first side wall proximate said rod's entrance opening so that a lock may be placed through said eye bolt and said rod's eye to secure said device, so that when said locking means is removed and said tube retaining means is withdrawn, said coin receiving tube falls through said base's bottom opening.

2. A device for counting coins to be used in conjunction with a compartmentalized coin sorter, said device comprising:

(a) a generally parallelpipedal, hollow base of a size to receive an open bottom end of a coin sorter on said base's top, said base including also side walls, a compartment forming wall, back and front walls and a partially open bottom, said bottom including a rectangular opening to provide access to tube compartments;

(b) at least one tube compartment of a size to hold a coin receiving tube, said compartment(s) extending vertically from said sorter, through said base's top, each defining an opening in said base's top, said compartments placed between a first side wall to said compartment forming wall;

(c) a plurality of coin receiving tubes, each open at one end and each sized circumferentially to receive coins of a different given denomination in stacked relationship, said coin tubes of a predetermined height, each holding by height the amount of coins of a given denomination to fill a standard coin wrapper of that given denomination, said tubes being removably mounted in said sorter's compartment(s);

(d) tube retaining means in said base to prevent said tube(s) from dropping from said compartment(s) through said base's bottom opening, said tube retaining means including:

(i) at least one transverse channel in said base's top from said front wall to said compartment openings to receive a tube retainer, said channel including a pin and a washer, said pin extending vertically through each slot so that said tube retainer(s) may not be completely removed from said slot(s), said washer placed between said pin head and said retaner to hold said retainer level; and, (ii) a tube retainer slidably mounted in each of said channels and of a length to extend horizontally through said channel(s) and across said tube compartment's(s') base end, supporting said tube's closed bottom thereon, said tube retainer being generally a slotted rectangular bar having one end of said bar extending out of said base's top, said extending end enlarged for grasping by a user's fingers;

(e) a U-shaped encasement on said coin sorter's top and side walls, said encasement attached to said base;

(f) means to lock said tube(s) in said base, said locking means including:

(i) a locking rod slidably and removably mounted through said base's first side wall, into an aperture in said compartment forming wall, said rod's one end end ending in an eye; and, (ii) an eye bolt located on said first side wall proximate said rod's entrance opening, so that a lock may be placed through said eye bolt and said rod's eye to secure said device;

(g) aids, said aids being tubes sized to hold an open coin wrapper of a given denomination, said tubes capable of receiving an end of said coin receiving tube of the same given denomination so that, when a wrapper is placed in said aid and a filled coin receiving tube is placed in said aid's end, said coin will be transferred in stacked relationship into said wrapper;

(h) a compartment in said coin sorter to store said aids, said compartment sharing said coin sorter's front wall and having two side walls and being open on said back wall of said sorter, said side walls including hooks to hold an aid retaining band, so that when said locking means is removed and said tube retaining means is withdrawn, said coin receiving tube falls through said base's bottom opening and coins are transferred from said tubes through said aids into a coin wrapper.

3. A device for counting coins to be used in conjunction with a compartmentalized coin sorter, said device comprising:

(a) a generally parallelpipedal, hollow base of a size to receive an open bottom end of a coin sorter on said base's top, said base including also side walls, a compartment forming wall, back and front walls and a partially open bottom, said bottom including a rectangular opening spanning all tube compartments to provide access to tube compartments;

(b) at least one tube compartment of a size to hold a coin receiving tube, said compartment(s) extending vertically from said sorter, through said base's top, each defining an opening in said base's top, said compartments placed between a first side wall to said compartment forming wall;

(c) a plurality of coin receiving tubes, each open at one end and each sized circumferentially to receive coins of a given different denomination in stacked relationship, said coin tubes of a predetermined height, each holding by height the amount of coins of a given denomination to fill a standard coin wrapper of that given denomination, said tubes being removably mounted in said sorter's compartment(s);

(d) tube retaining means in said base to prevent said tube(s) from dropping from said compartment(s) through said base's bottom opening, said tube retaining means including:

(i) at least one transverse channel in said base's top from said front wall to said compartment openings to receive a tube retainer, said channel including a pin and a washer, said pin extending vertically through each slot so that said tube retainer(s) may not be completely removed from said slot(s), said washer placed between said pin head and said retainer to hold said retainer level; and, (ii) a tube retainer slidably mounted in each of said channels and of a length to extend horizontally through said channel(s) and across said tube compartment's(s') base end, supporting said tube's closed bottom thereon, said tube retainer being generally a slotted rectangular bar having one end of said bar extending out of said base's top, said extending end enlarged for grasping by a user's fingers;

(e) a U-shaped encasement on said coin sorter's top and side walls, said U-shaped encasement attached by a first leg to one of said base's sides by screws, said base's other side receiving a second leg, said second leg including a lip to prevent its removal from said base's other side;

(f) means to lock said tube(s) in said base, said locking means including:

(i) a locking rod slidably and removably mounted through said base's first side wall, into an aperture in said compartment forming wall, said rod's one end ending in an eye; and, (ii) an eye bolt located on said first side wall proximate said rod's entrance opening, so that a lock may be placed through said eye bolt and said rod's eye to secure said device;

(g) aids, said aids being tubes sized to hold an open coin wrapper of a given denomination, said tubes capable of receiving an end of said coin receiving tube of the same given denomination so that, when a wrapper is placed in said aid and a filled coin receiving tube is placed in said aid's end, said coins will be transferred in stacked relationship into said wrapper;

(h) a compartment in said coin sorter to store said aids, said compartment sharing said coin sorter's front wall and having two side walls and being open on said back wall of said sorter, said side walls including hooks to hold an aid retaining band, so that when said locking means is removed and said tube retaining means is withdrawn, said coin receiving tube falls through said base's bottom opening and coins are transferred from said tubes through said aids into a coin wrapper.

* * * * *